US007506395B2

(12) United States Patent
Eldridge

(10) Patent No.: US 7,506,395 B2
(45) Date of Patent: Mar. 24, 2009

(54) PIPE CLEANING TOOL

(75) Inventor: Odis Mason Eldridge, Foster, KY (US)

(73) Assignee: Odie Mfg., Wilder, KY (US)

( * ) Notice: Subject to any disclaimer, the term of this patent is extended or adjusted under 35 U.S.C. 154(b) by 79 days.

(21) Appl. No.: 10/971,226

(22) Filed: Oct. 22, 2004

(65) Prior Publication Data

US 2006/0085930 A1 Apr. 27, 2006

(51) Int. Cl.
*B08B 9/00* (2006.01)

(52) U.S. Cl. ..... 15/104.05; 15/104.03; 15/104.16

(58) Field of Classification Search ..... 15/104.03, 15/104.05, 104.16
See application file for complete search history.

(56) References Cited

U.S. PATENT DOCUMENTS

| | | | | | |
|---|---|---|---|---|---|
| 195,181 | A | * | 9/1877 | Strohm | 15/104.16 |
| 743,702 | A | | 9/1903 | Fink, Jr. | |
| 774,510 | A | | 5/1904 | Fink, Jr. | |
| 875,832 | A | * | 1/1908 | Mann | 15/104.16 |
| 986,844 | A | * | 3/1911 | McCloskey | 15/104.05 |
| 1,098,128 | A | * | 5/1914 | Schlacht | 15/104.16 |
| 1,159,977 | A | * | 11/1915 | Massey et al. | 15/104.05 |
| 1,190,277 | A | | 7/1916 | Flynn | |
| 1,297,446 | A | | 3/1918 | Collins | |
| 1,275,571 | A | * | 8/1918 | Leslie | 15/406 |
| 1,467,492 | A | | 9/1923 | Olson | |
| 1,553,034 | A | | 9/1925 | Donnelly | |
| 3,922,746 | A | | 12/1975 | Strunk | |
| 4,391,289 | A | | 7/1983 | Adams | |
| 4,898,201 | A | | 2/1990 | Conley et al. | |
| 5,566,704 | A | | 10/1996 | Ackroyd et al. | |
| 5,752,542 | A | | 5/1998 | Hoeptner, III | |
| 5,840,128 | A | | 11/1998 | Imig | |
| 6,325,090 | B1 | | 12/2001 | Horne et al. | |
| 6,349,736 | B1 | | 2/2002 | Dummire | |
| 6,513,543 | B1 | | 2/2003 | Noll et al. | |

* cited by examiner

*Primary Examiner*—Mark Spisich
(74) *Attorney, Agent, or Firm*—R. Christian Macke

(57) ABSTRACT

A pipe cleaning tool comprises a rod slidably retained in a housing. The housing is affixed to a pipe in the area of the blockage so that, when affixed, the rod slides through the housing and through the blocked pipe. The end of the rod is pushed into and through the blockage, allowing free flow of fluid through the pipe to resume. A blowout port on the housing is in fluid communication with a rod bore in the housing through which the rod slides so that, when the blockage is removed, fluid flows out through the rod bore and out the blowout port. Fluid flowing out through the blowout port can then be controlled and directed by coupling a hose to the blowout port. The pipe cleaning tool is particularly useful to remove blockages in the test cocks of backflow prevention valves.

1 Claim, 7 Drawing Sheets

PIPE CLEANING TOOL

FIELD OF THE INVENTION

This invention relates to a tool for removing obstructions in pipes through which fluid flows and, more particularly, to a device for cleaning out test cocks of backflow prevention valves through which pressurized water flows into a facility.

BACKGROUND OF THE INVENTION

The supply of public water to industrial facilities is and has long been a necessity for progress and efficient manufacturing and production. In addition, the need to provide a means for treating and discharging waste water used by industrial facilities has also been a concern, not only to allow the industry to run efficiently, but also because of safety concerns about the dangers of releasing contaminated wastewater into the environment.

Significant environmental regulations have been implemented to insure the safety and necessity of waste water treatment to protect the health of citizens whose water might be contaminated. Only recently have federal and local governments and regulatory agencies begun to recognize the necessity for also insuring that contamination does not get into the water supply through water inlet lines. To that end, many governments and regulatory authorities have begun to require the installation of backflow prevention valves in industrial facilities that protect against contamination of the public water supply by preventing industrial, or other, wastewater from "backflowing" out through the incoming line. In the case of a loss of pressure in the public supply, such as occurs during water main breaks or during utility line repair work, a loss of pressure at the incoming water line could result in industrial process water being pushed back out through the inlet. When pressure is restored, the industrial process water contaminating the water supply is pushed downstream to subsequent users. Backflow prevention valves have only recently begun to be mandated to prevent such occurrence.

As with any other technology, backflow prevention valves can only serve their purpose if they are properly maintained and operable. Thus, part of many of the laws and regulations compelling the installation and use of backflow prevention valves are requirements that the backflow prevention valves are periodically tested, typically annually, to make sure they are operating properly. While a boon to maintenance personnel whose job it is to insure proper operation and regulatory compliance, the testing of backflow prevention valves has proven to present at least one annoying problem to those maintaining them. Because of the infrequency with which the valves are operated (often they will go an entire year between tests without ever being operated), parts are worn out quickly and, significantly for purposes of the present invention, blockages resulting from sediment build-up or, most frequently, calcium deposits, can result in smaller areas of the backflow prevention valve through which the supply water flows. The problem associated with blockages formed from calcium deposits is particularly acute in the test cocks of backflow prevention valves. Typical backflow prevention valves such as that shown in U.S. Pat. No. 6,325,090 have four test cocks to which a valve tester is attached to check and confirm proper operation of the backflow prevention valves. By attaching three test hoses of a tester alternately at the four test cocks positioned on both sides of the two check valves in a backflow prevention valve, such as that shown in U.S. Pat. No. 5,566,704, proper operation of the backflow prevention valve can be checked.

A problem that typically arises, however, is that the test cocks, mounted on the side of the backflow prevention valves, are a prime spot for the collection of calcium deposits. It is axiomatic that, if the test cocks are blocked, the tester, which relies on fluid flow under pressure through the test cock, will be useless.

Thus, it has become common practice for plumbers responsible for checking for the proper operation of backflow prevention valves to first "clean out" the test cock before attaching the tester. This "clean out" is difficult because the plumber must depress a piston while shoving a rigid wire down through the test cock. He knows he has been successful when water comes spraying out the test cock, which is the second problem. The plumber and his paperwork (data must be recorded for regulatory compliance) can get soaked in the process of cleaning out just one backflow prevention valve. To make matters worse, backflow prevention valves are typically difficult to access, coming in to an individual facility above ground so that the plumber is required to be on a ladder to "clean out" the test cocks and check operation of the backflow prevention valve.

There is thus identified a need for a tool that is portable and which may quickly and easily be attached to test cocks on backflow prevention valves that removes blockages therein allowing maintenance personnel to test the operation of the backflow prevention valve without getting wet from the fluid spray when the blockage is removed.

OBJECTS OF THE INVENTION

It is an object of the present invention to provide a pipe cleaning tool that is portable and which may be quickly attached to and removed from a pipe such that a clean out rod can be moved through the pipe to break up sedimentary blockage therein.

It is another object of the present invention to provide a pipe cleaning tool having visible indication provisions to let maintenance personnel working on the pipe know when the blockage has been cleared.

It is yet another object of the present invention to provide a pipe cleaning device having a blowout port allowing fluid to be directed therefrom into a discharge receptacle.

It is a further object of the present invention to provide a pipe cleaning device having a blowout port allowing fluid to be discharged and directed away from the maintenance personnel using the device.

It is a further object of the present invention to provide a test cock cleanout device that attaches to the test cock and removes blockage therein while also indicating to the user when the blockage has been removed.

It is yet another object of the present invention to provide a test cock cleanout device for use with backflow prevention valves that is installed in-line with a valve tester.

These and other objects and advantages of the present invention will be apparent from a review of the following specification and accompanying drawings.

SUMMARY OF THE INVENTION

The present invention comprises a pipe cleaning tool comprising a housing and a rod slidably positioned in the housing. A means for retaining the rod in the housing is provided in the preferred embodiment, as well as a means for affixing the housing to a pipe whereby a cleaning end of the rod is free to slide into and out of the pipe, breaking up sediment and calcium deposits in so doing.

The cleanout rod has a circular cross section and the housing has a corresponding cylindrical bore through it of slightly greater diameter than the circular cross section of the rod. The means for affixing the housing to a pipe is adjacent to a first end of the cylindrical bore, which extends completely through the housing to define a second, opposed, end of the cylindrical bore. The rod is of sufficient length to extend completely through the cylindrical bore and out both ends of the housing.

The rod, which predominately is present in the housing, with only ends sticking out, comprises a handle end and a cleaning end. When the rod is properly positioned in the housing, the cleaning end extends from one end of the cylindrical bore and the handle end extends from the other end of the cylindrical bore.

A means for sealing the cylindrical bore around the handle end is provided so that, when the blockage is removed, fluid does not spray the user. The housing is also provided with a blow out port which is in fluid communication with the cylindrical bore. The blow out port is utilized by connecting to it a means for directing fluid, provided in the most preferred embodiment by a flexible hose and means for connecting the hose to blow out port, which directs fluid exiting the blowout port into a discharge receptacle.

It is contemplated that the pipe cleaning tool of the present invention may be used by being attached to a test cock and the blockage blown out through a flexible hose, as set forth above, but it also is provided with means for inserting the tool in-line with a valve tester, comprising means for securing a test hose of the tester to the blow out port. A means for securing a test hose to the blow out port is provided comprising a fitting having an externally threaded nipple sized to engage an internally threaded coupling affixed to said test hose.

The preferred embodiment of the pipe cleaning tool of the present invention is provided with a shoulder mounted on the rod, adjacent to the cleaning end, the shoulder having a larger cross section than the circular cross section of the rod, and a stepped down length of the cylindrical bore in the housing that is smaller than the shoulder on the rod, defining the means for retaining the rod in the housing. Another feature important to retaining the rod in the housing is a handle affixed to one end of the rod exterior to the housing.

The present invention is also a test cock cleanout device comprising a housing, a rod slidably mounted in the housing, means for retaining the rod in the housing, and a means for affixing the housing to a test cock whereby a cleaning end of the rod is free to slide through the test cock. The means for affixing is more particularly described as an externally threaded extension of the housing received by an internally threaded test cock, and, further, may include a bushing inserted into the test cock, the bushing having external threads to engage the internally threaded test cock and internal threads to be engaged by the externally threaded extension.

The test cock cleanout device of the present invention also includes means for indicating flow through the test cock cleanout device. In the preferred embodiment, the means for indicating comprises a bore in the housing, the bore being sized such that the rod is free to move therein. The fluid under pressure in the test cock travels through the bore and out through a blowout port in said housing, where it is visually indicated to the user that the blockage has been removed.

The test cock cleanout device of the present invention is alternatively described as a housing, a movable member retained in the housing, means for moving the movable member through the test cock to engage and break through blockage, means for visually confirming that the blockage has been removed. Specifically, a bore in the housing is in fluid communication with a test cock and a blow out port in the housing in fluid communication with the bore.

DETAILED DESCRIPTION OF THE INVENTION

Figure 1:
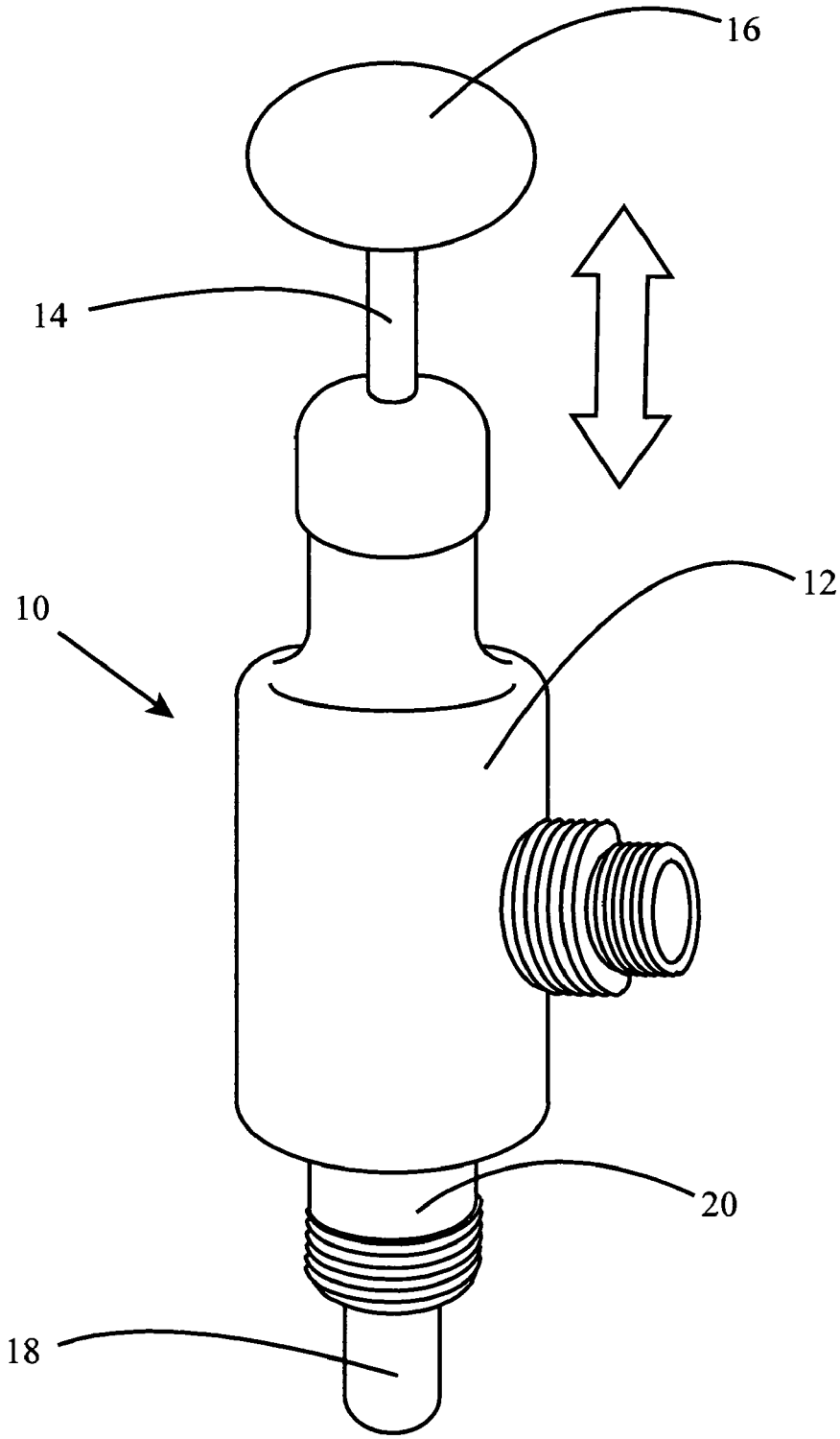
FIG. 1 is a perspective view of the pipe cleaning tool of the present invention.

The pipe cleaning tool 10 of the present invention, depicted in FIG. 1, comprises a housing 12 and a rod 14 which is positioned within the housing 12 but is free to move relative to the housing 12 in the direction shown. An operator uses the pipe cleaning tool 10 by attaching an end 20 of the housing 12 to a pipe and sliding the rod 14 back and forth, through the housing 12 to allow the cleaning end 18 of the rod 14 to engage and break through sediment, calcium deposits, or other blockages in the pipe to be cleaned. In the most preferred embodiment, the operator manually grabs the handle 16 and alternately pushes and pulls the rod 14 through the housing 12. The pipe cleaning tool 10 of the present invention is particularly well suited to being used to clean out short lengths of pipe such as test cocks installed to allow testing and operation of valve components, or gage cocks installed to allow monitoring of fluid flow, pressure, temperature.

Figure 2:
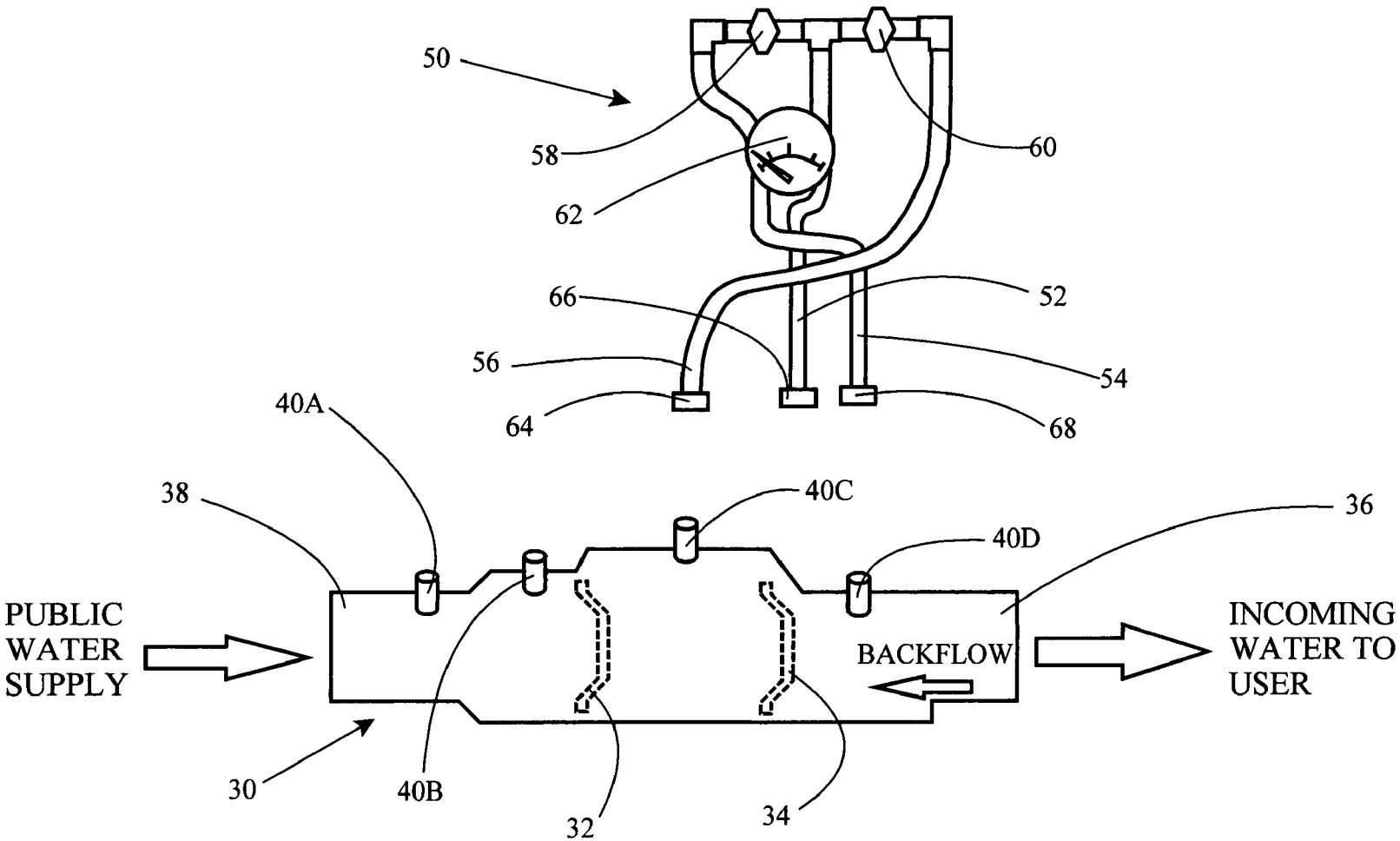
FIG. 2 is a schematic representation of a typical backflow prevention valve and tester.

One specific use of the test cock cleanout device 10 of the present invention is in association with a backflow prevention valve 30 (see FIG. 2). In practice, the backflow prevention valve operates to prevent backflow, in the direction indicated, through the use of two check valves 32, 34. The check valves 32, 34 are biased open by the incoming public water supply and allow flow through the backflow prevention valve 30 to provide incoming water to a user.

The backflow prevention valve 30 depicted in FIG. 2 is typical and, in many jurisdictions and districts, required for industrial uses of water. By allowing water to flow in only one direction, the backflow prevention valve operates to keep water from being pushed from the user end 36 as backflow through the valve 30 if pressure is lost on the supply side 38 of the valve. While generally infrequent, supply side pressure may be lost in the event of a water main break or if maintenance work is being done on the line nearby.

Backflow prevention valve 30 is typical of a compulsory valve, not only through its use of two check valves 32, 34, but also by its inclusion of four test cocks 40A, 40B, 40C, 40D. In addition to requiring installation of backflow prevention valves, statutes and regulatory authorities generally also define a required maintenance check up period, typically a year, during which the backflow prevention valve 30 must be checked and operated. A tester 50 (see FIG. 2) is used for that purpose, as follows. A low pressure hose 52 and a high pressure hose 54, along with a pressure supply hose 56, are alternately attached to the test cocks 40A, 40B, 40C and 40D, and pressure applied to actuate the operation of the check valves 32, 34. The tester also includes on/off ball valves 58, 60 to allow isolation of the low hose 52, high hose 54 and supply hose 56. Finally, the tester 50 includes a pressure meter 62 which monitors the pressure at which the check valves 32, 34 operate. It is the value gleaned from the pressure meter 62 that must be recorded, and which must be compliant with laws and regulations. Typically an operator will manually record the necessary pressure data from an analog meter, such as that shown in FIG. 2, although digital meters providing an automatic printout are also known in the prior art.

The tester 50 is attached to the test cocks 40A, 40B, 40C, 40D by internally threaded caps 64, 66, 68 secured to the ends of the low hose 52, the high hose 54, and the supply hose 56. The caps 64, 66, 68 are secured to the test cocks 40A, 40B, 40C, 40D, which are also internally threaded, through the use of fittings or bushings 70, as shown in FIG. 2. By carrying fittings of many different sizes, a single tester 50 can be adapted to a wide array of test cock sizes by merely changing the fittings. Depending on the size of the incoming supply and the backflow prevention valve therein, the test cocks 40A, 40B, 40C, 40D may range in size from ⅜ inches to 1.5 inches.

Figure 2A:
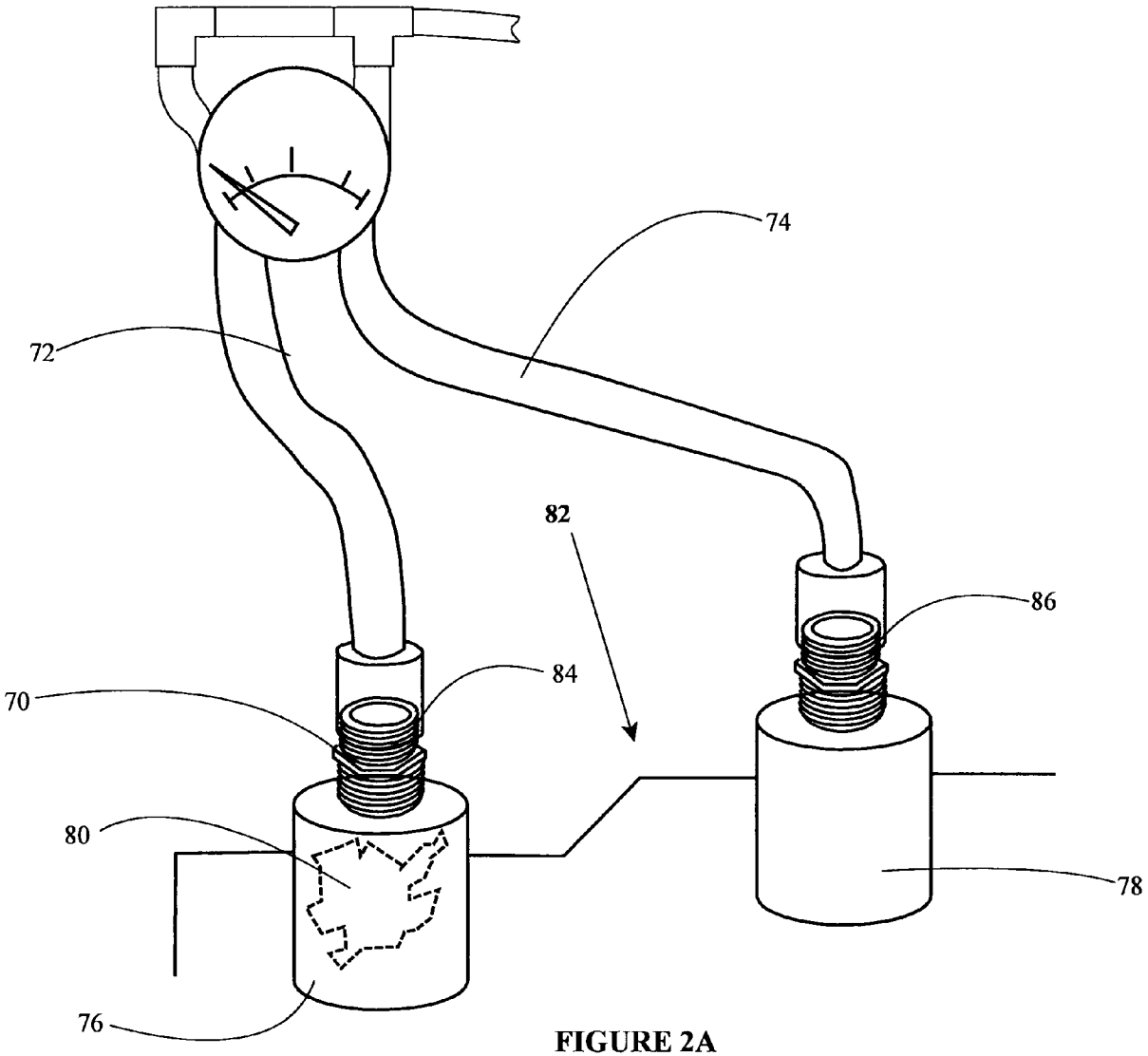
FIG. 2A is a partial view illustrating the connections between the backflow prevention valve and tester.
Figure 4:
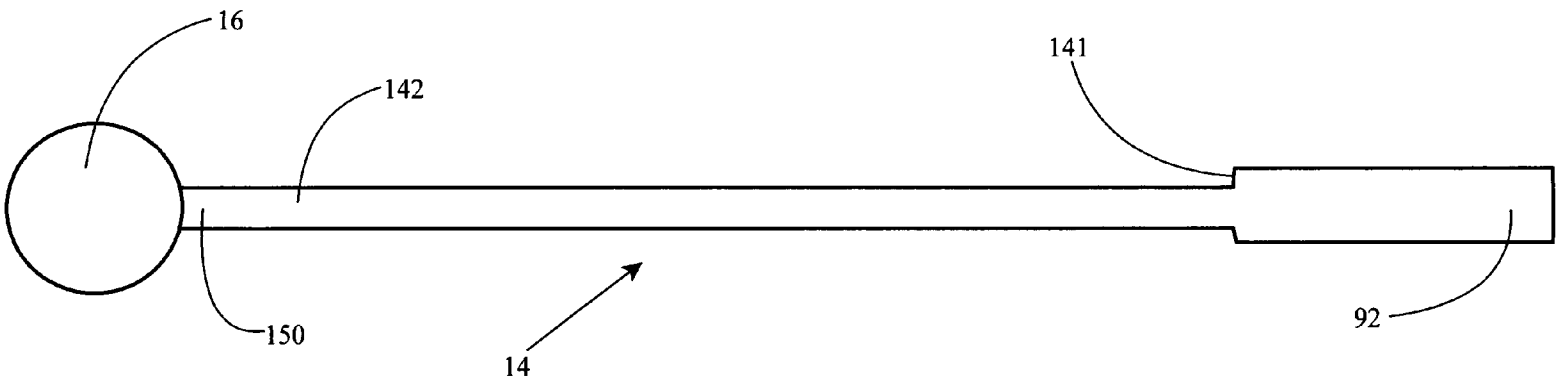
FIG. 4 is a side view of the cleanout rod of the present invention separate and apart from the housing.

FIG. 2A depicts the low hose 72 and high hose 74 as being coupled to two test cocks 76, 78 of a backflow prevention valve 82, through the use of fittings 84, 86, shown in FIG. 2A. A schematically depicted blockage 80 in test cock 76 is illustrative of the problem inherent in backflow prevention valves; if a test cock is clogged, the tester 50 will be useless to ascertain relative high and low pressures or to properly operate the backflow prevention valve 30.

Environmental regulations and state and federal law mandate the use and periodic testing of a backflow prevention valve 30. Often, though, the annual maintenance and operation of the check valves 32, 34 is the only time the backflow prevention valve 30 is operated. In a year's time, significant amounts of calcium deposits and sediment builds up in the test cocks 40A, 40B, 40C, 40D of a backflow prevention valve. This build up prevents the accurate assessment of the backflow prevention valve because, as depicted in FIG. 2A, blockage 80 in the test cock 76 will result in a false pressure reading at the low hose 72.

Prior to the present invention, maintenance personnel charged with checking the operation of a backflow prevention valve 30 would manually force a piece of rigid wire down into the test cocks 40A, 40B, 40C, 40D to break apart any blockage therein. Once the blockage was pierced, typically the line pressure blows out the remaining blockage, along with supply water. The result is generally a soggy service man and paperwork from the spray of four test cocks on each backflow prevention valve.

The most preferred embodiment of the present invention comprises a test cock cleanout device 10 comprising a housing 12 and a rod 14 slidably positioned within a bore 100 formed within the housing 12. When a first end 13 of the housing 12 is attached to a test cock 90 (see FIG. 6), the cleaning end 92 of the rod 14 is moved back and forth through the test cock 90 (as indicated by the arrow in FIG. 6). In this way, any blockage in the test cock 90 is broken up by the cleaning end 92 of the rod 14 and, under water pressure in the backflow prevention valve, either pushed out through the system or out through the test cock 90.

Figure 5:
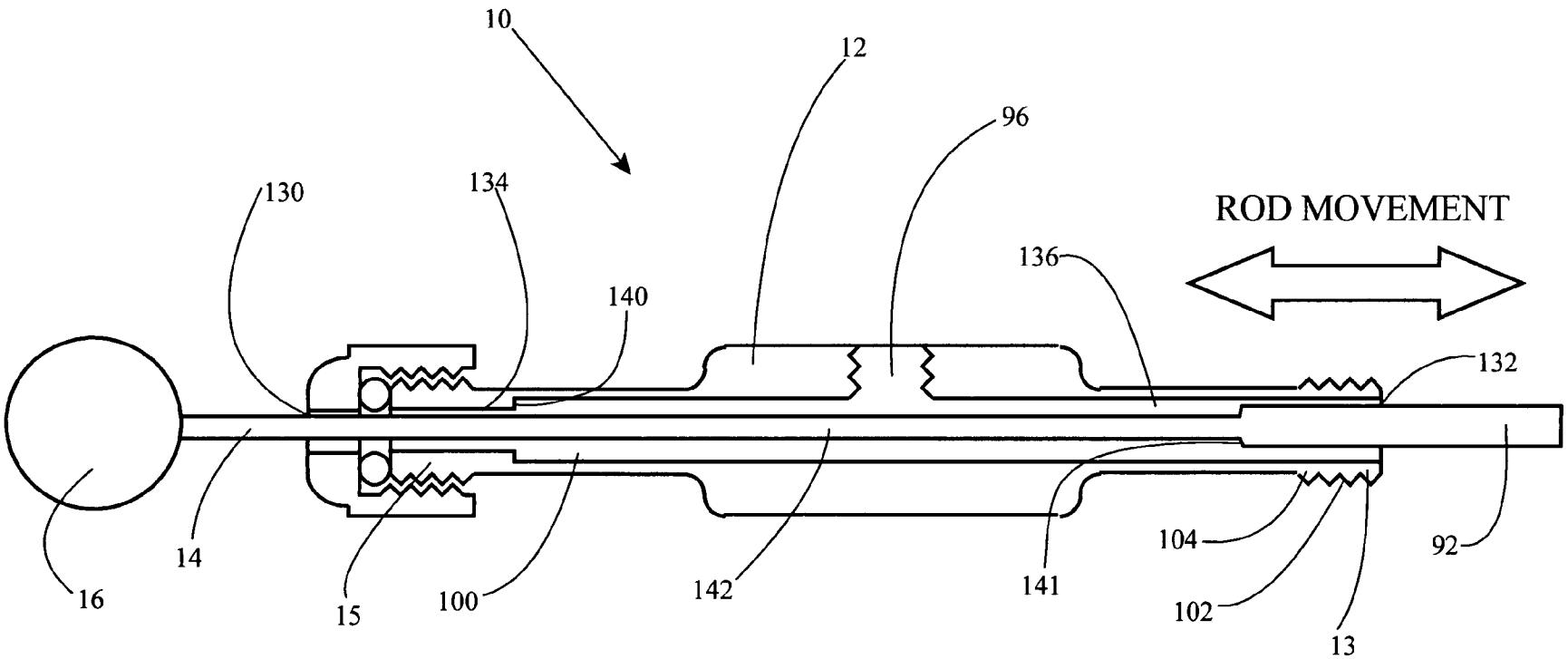
FIG. 5 is a side view of the test cock cleanout device of the present invention illustrating the blowout port in the housing.

In the most preferred embodiment, the test cock cleanout device 10 also comprises a blowout port 96 in fluid communication with the bore 100 formed in the housing 12 (see FIG. 5). The blowout port 96 itself comprises a bore in the housing 12 which intersects the bore 100 through which the rod 14 travels, such that fluid under pressure in the test cock 90 will be expelled through the bore 100 and out the blowout port 96.

Insofar as the bore 100 in the housing 12 is larger than the rod 14, when the housing 12 is attached to the test cock 90, as soon as the blockage is removed from the test cock 90 fluid under pressure flows up through the bore 100 and out the blowout port 96. In this way, the operator gets instant visual confirmation that the blockage has in fact been removed and that flow through the test cock 90 has been effected. While a simple means of visual confirmation, seeing water expelled from the blowout port 96 is critical to the principles of the present invention, because it prevents a user of a test cock cleanout device 10 from attaching the housing 12 to the test cock, pushing the handle 16 down to force the cleaning end 92 into the test cock 90, removing the test cock cleanout device 10 from the test cock, and attaching the tester 50, only to find that he needs to repeat the use of the test cock cleanout device 10. Other means of visual confirmation can be used and are specifically contemplated by the principles of the present invention, such that the use of a flowmeter, pressure meter, or visible window will all suffice to provide the necessary visual confirmation of blockage removal.

Figure 6:
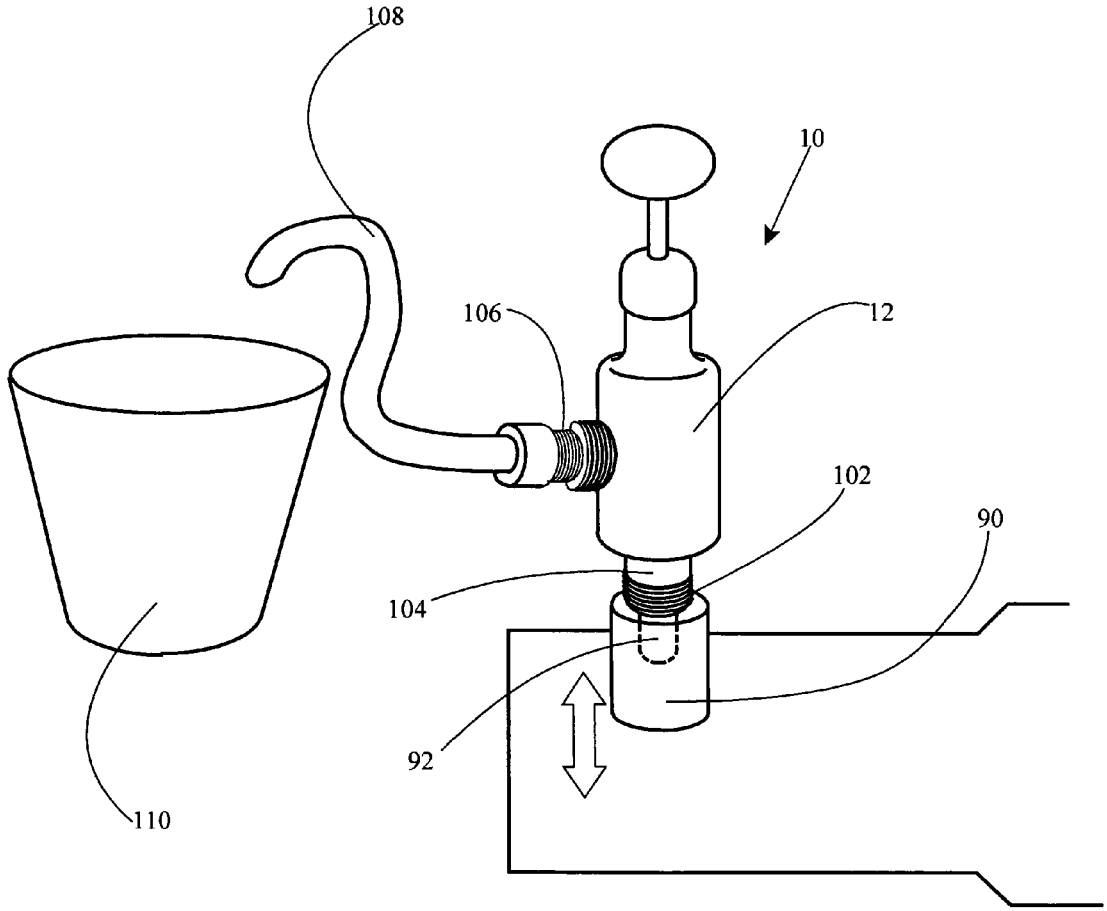
FIG. 6 is a schematic representation of the test cock cleanout device of the present invention secured to a test cock of a backflow prevention valve, with flow out of the blowout port directed into a receptacle.
Figure 7:
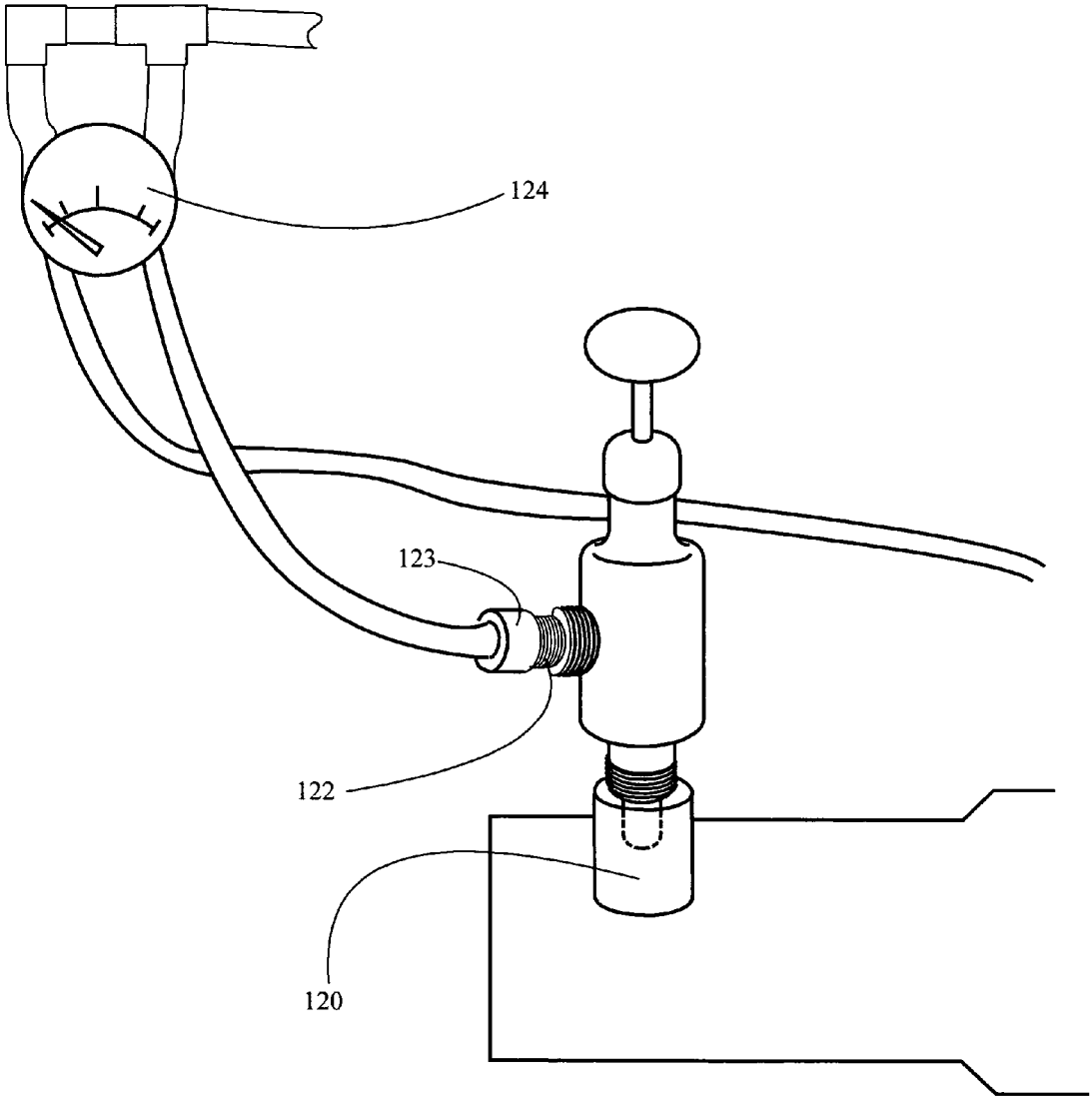
FIG. 7 is a schematic representation of the test cock cleanout device of the present invention attached in-line with a tester so that the test cock cleanout device does not have to be removed to allow use of the tester.

The means for attaching the housing 12 to a pipe or test cock, such as shown in FIG. 6, is provided by external threads 102 on the housing 12. In the most preferred embodiment of the present invention, the threaded extension 104 is ⅜ inch, to accommodate the majority of internally threaded test cocks without requiring the use of a fitting. To accommodate larger test cocks, a bushing between the threaded extension 104 and the test cock is utilized to secure the housing 12 thereto.

The test cock cleanout device 10 of the present invention may be utilized two different ways. First, it may be attached to a test cock 90 and the cleaning end 92 of the rod 14 is pushed into the test cock 90 until fluid flow of the blowout port 96 (and attached fitting 106 and flexible hose 108 in FIG. 6) is detected. At that point, the test cock cleanout device 10 is detached and similar cleanout procedures are done for the remaining test cocks, and the tester is then systematically attached across the test cocks, now blockage free, of the backflow prevention device to confirm proper operation in compliance with the law and regulatory guidelines. If used in this manner, the test cock cleanout device 10 has a fitting 106 installed in the blowout port 96 with a flexible length of hose 108 affixed thereto that allows the user to direct the fluid expelled under pressure into a discharge receptacle such as a bucket 110 (FIG. 6).

The test cock cleanout device 10 of the present invention may also be used by being attached to a test cock 120 while having a fitting 122 in the blowout port 96 that is appropriately sized (typically ⅜ inch) to engage an internally threaded cap 123 of a backflow prevention valve tester 124. The test cock cleanout device 10 may thus be used to remove blockage in the test cock 120 and then left in-line with the tester 124. In this arrangement, the operator gets visual confirmation of the blockage removal by seeing the change in pressure at the tester 124.

Means for retaining the rod 14 in the housing 12 are provided by bore 100 through the housing 12 having a first end 130 and a second end 132. In the most preferred embodiment of the present invention, a smaller diameter bore 134 is formed the length of the housing 12, and then a larger diameter bore 136 is formed concentrically to the smaller bore 134.

The result is a step down in bore size from the larger bore 136 to the smaller bore 134, creating an annular surface 140. Similarly, the rod 14 is provided with a coordinated and inverted step up shoulder 141 adjacent to the cleaning end of the rod 92 extending from the first end 13 of the housing. The shoulder 141 is formed as a result of a smaller cross section at the handle end 142 of the rod compared to the larger cross section at the cleaning end 92 of the rod 14. That is, the cleaning end 92 of the rod 14 has a greater diameter than the opposite handle end of the rod 142, and the rod 14 is rigid so that the rod shoulder 141 is larger than the reduced bore 134. As the rod 14 is pulled up into the housing 12, it is free to move until the shoulder 141 contacts the annular surface 140 between the larger bore 136 and smaller bore 134. This feature is particularly important because, as the cleaning end 92 of the rod pushes through sediment blockage in the test cock, the fluid under pressure in the test cock will act to push the rod 14 outwardly. The means for retaining the rod 14 in the housing 12 provided by the rod shoulder 141 and bore annular surface 140 prevents the rod 14 from being blown out of the housing 12, while still allowing free movement of the rod 14 within the housing 12.

It is specifically contemplated that other elements and features may be used to retain the rod 14 in the housing 12 as well, including without limitation, raised lips on the rod 14, inwardly extending protuberances in a single bore, etc. The means for retaining the rod 14 in the housing 12 is the coordinated relationship between overlapping elements on the rod 14 and housing 12 which restrict the travel of the rod 14 through the Housing in a direction away from the test cock.

The means for retaining the rod 14 within the housing 12 further comprises elements for restricting the travel of the rod 14 into the second end 15 of the housing 12 in the direction of the test cock. In the most preferred embodiment, a handle 16 is provided at handle end 150 of the rod 14. The handle 16 is securely affixed to the smaller end 150 of the rod 14 and is large enough that it will not pass through the smaller bore 134 in the housing 12. The handle 16 snaps onto rod 14 and includes gripping provisions to prevent separation in the most preferred embodiment, but mechanical fixture devices such as a bolt extending through the handle 16 and rod 14 or adhesive, are specifically contemplated and do not depart from the principles of the present invention.

Figure 3:
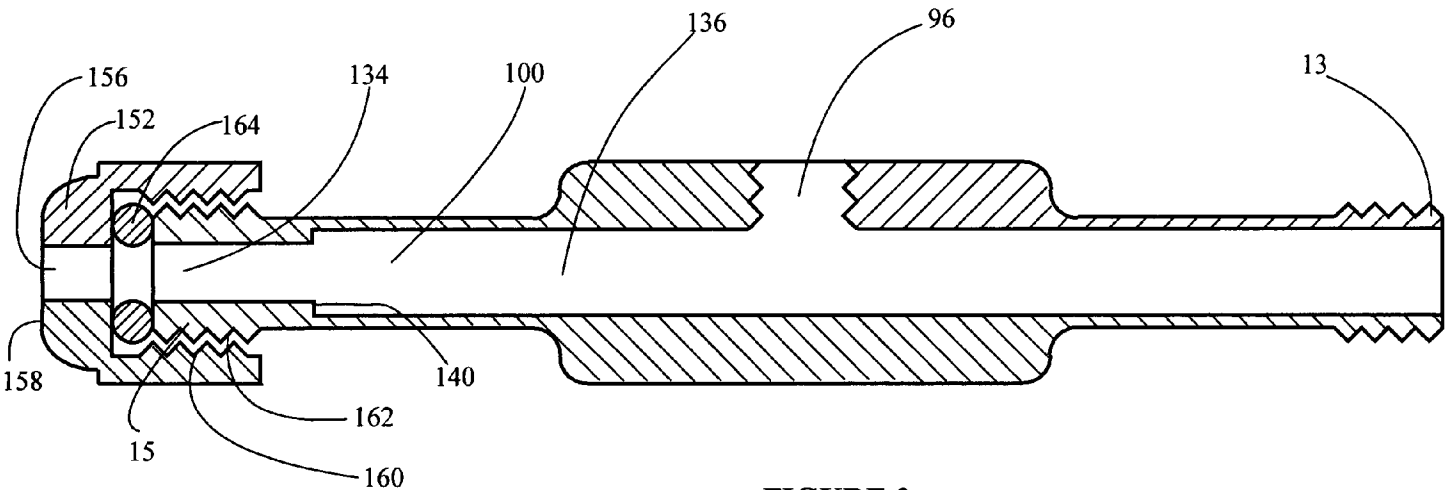
FIG. 3 is a sectional view of the housing of the present invention.

In the most preferred embodiment, a cap 152 is provided at the second end of the housing opposite to the first end 13 attaching to the test cock, and provides a means for sealing the cylindrical bore 134. A circular opening 156 in the cap 152 is provided to allow clearance for the narrower cross section 142 of the rod 14 while the outer surface 158 restricts the travel of the rod 14 into the housing 12. The cap 152 has interior threads 160 which cooperate with exterior threads 162 on the second end 15 of the housing 12 to tighten the cap 152 down onto the housing 12. A circular O-ring 164 is inserted between the cap 152 and housing 12 (see FIG. 3) to seal off the bore 134 and prevent fluid from exiting out through the cap 152.

The handle 16 is rigid and shaped to accommodate a user's manual operation of grabbing the handle 16 and pushing and pulling the rod 14 through the housing 12 to move the cleaning end 92 through the test cock being cleaned out. The means for retaining the rod 14 in the housing 12 provided by the handle 16 and outer surface 158 of the cap 152 are intended to be illustrative and not restrictive, and other devices and elements providing similar mechanical restrictions preventing the rod 14 from being pushed too far into the housing 12 are specifically contemplated and do not depart from the principles of the present invention.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A cleaning tool comprising:

a substantially straight and elongated housing having opposed first and second ends, the housing being formed as a one-piece body and having a cylindrical bore extending therethrough from the first to the second end thereof, each of the first and second ends of the housing including external threads provided directly on an outer surface thereof, the housing further including a blow-out port formed therein between the ends thereof, the blow-out port being in fluid communication with the cylindrical bore, the bore including a smaller diameter portion extending from the first end to a region between the first end and the blow-out port as well as a larger diameter portion extending from the smaller diameter portion to the second end of the housing, the region at which the two bore portions meet defining an annular stepped down surface;

an elongated rod slidably positioned in said cylindrical bore of said housing and including opposite ends, said rod having a handle at one of the ends and a cleaning end at the other end, the portion of the rod between the handle and the cleaning end having a smaller cross-section than both the handle and the cleaning end thereof, the meeting of the smaller portion of the rod and the cleaning end thereof defining a shoulder;

a cap provided with internal threads for engaging the external threads on the first end of the housing, the cap further including an opening such that when the cap is secured to the first end of the housing the rod may pass therethrough;

the cap and the stepped down surface of the bore cooperate with the handle and the shoulder at the cleaning end of the rod to define a means for retaining said rod in said housing;

an O-ring between the cap and the first end of the housing for sealing off the bore and preventing fluid from exiting out through the cap; and whereby the threads on the second end of the housing are adapted to engage internal threads in either a check valve or a test cock such that the cleaning end of the rod is free to slide into and out of the check valve or test cock to remove blockages therefrom, the blow-out port comprising at least in part a means for providing visual confirmation of blockage removal.

* * * * *